US008160265B2

(12) United States Patent
Mao et al.

(10) Patent No.: US 8,160,265 B2
(45) Date of Patent: Apr. 17, 2012

(54) METHOD AND APPARATUS FOR ENHANCING THE GENERATION OF THREE-DIMENSIONAL SOUND IN HEADPHONE DEVICES

(75) Inventors: Xiaodong Mao, Foster City, CA (US); Noam Rimon, Redwood City, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 443 days.

(21) Appl. No.: 12/467,366

(22) Filed: May 18, 2009

(65) Prior Publication Data

US 2010/0290636 A1 Nov. 18, 2010

(51) Int. Cl.
*H04R 1/10* (2006.01)

(52) U.S. Cl. ..... 381/74; 381/309

(58) Field of Classification Search ..... 381/74, 381/309; 702/152

See application file for complete search history.

(56) References Cited

U.S. PATENT DOCUMENTS

| | | | | |
|---|---|---|---|---|
| 4,787,051 | A | 11/1988 | Olson | |
| 4,843,568 | A | 6/1989 | Krueger | |
| 5,128,671 | A | 7/1992 | Thomas, Jr. | |
| 5,528,265 | A | 6/1996 | Harrison | |
| 6,157,368 | A | 12/2000 | Faeger | |
| 6,259,795 | B1 * | 7/2001 | McGrath | 381/310 |
| 6,369,952 | B1 * | 4/2002 | Rallison et al. | 359/630 |
| 6,375,572 | B1 | 4/2002 | Masuyama | |
| 7,502,477 | B1 * | 3/2009 | Inanaga et al. | 381/17 |
| 7,876,903 | B2 * | 1/2011 | Sauk | 381/17 |
| 2002/0085097 | A1 | 7/2002 | Colmenarez et al. | |
| 2004/0212589 | A1 | 10/2004 | Hall et al. | |
| 2006/0045294 | A1 * | 3/2006 | Smyth | 381/309 |

OTHER PUBLICATIONS

Bolt, R.A., "Put-that-there": voice and gesture at the graphics interface, Computer Graphics, vol. 14, No. 3 (ACM SIGGRAPH Conference Proceedings) Jul. 1980, pp. 262-270.

DeWitt, Thomas and Edelstein, Phil, "Pantomation: A System for Position Tracking," Proceedings of the 2nd Symposium on Small Computers in the Arts, Oct. 1982, pp. 61-69.

* cited by examiner

*Primary Examiner* — Kevin M Picardat
(74) *Attorney, Agent, or Firm* — Frommer Lawrence & Haug LLP; William S. Frommer; Paul A. Levy

(57) ABSTRACT

A headphone device includes a first and a second ear piece coupled to an assembly, wherein the assembly facilitates the placement of the first and second ear piece in relation to a user's ears. A motion transducer is coupled to the first or second ear piece, whereby the motion transducer measures real-time pitch and roll movement associated with the user's head. An electronic compass is also coupled to the first or second ear piece, and measures real-time yaw movement associated with the user's head. A processing device associated with each of the first and second ear piece processes an audio signal according to a head-related-transfer-function selected from a plurality of head-related-transfer-functions on the basis of the measured pitch, roll, and yaw movement of the user's head. The processed audio signal is then applied to the first and second ear piece, and generates a virtual three-dimensional sound corresponding to the selected head-related-transfer-function.

22 Claims, 5 Drawing Sheets

METHOD AND APPARATUS FOR ENHANCING THE GENERATION OF THREE-DIMENSIONAL SOUND IN HEADPHONE DEVICES

BACKGROUND

1. Field of the Invention

This invention relates generally to headphones, and more specifically, to enhancing the generation of three-dimensional sound in headphones.

2. Background Discussion

Human ears typically perceive two signals (i.e., one at each ear), whereby based on these signals, they are able extract enough information to determine the location from which sound emanated with respect to the three-dimensional space around them. Since the human hearing faculty is able to three-dimensionally discern sounds from the real world around us, it is therefore possible to create the same effect from two speakers or a set of headphones. The localization of sound based on hearing comes from a few mechanisms associated with human hearing. For example, Inter-aural Intensity Difference (IID) refers to the fact that a sound source appears louder at the ear that it is closest to, while Inter-aural Time Difference (ITD) refers to sound arriving earlier at the ear it is closest to. The combination of IID and ITD mechanisms provide a means for the primary localization of sound while the pinna, which is the outer structure of the ear, provides a filtering mechanism (i.e., outer ear effects) that allows the brain to accurately determine the location of the sound. As sound travels, it experiences different effects during propagation, such as, for example, reflection, diffraction, attenuation, etc. By hearing these effects, we are able to perceive certain information about the environment around us (e.g., room size, etc.).

In order to generate sound as it is heard in our three-dimensional surroundings, various listening cues such as IID, ITD, and outer ear effects may be recreated (i.e., electronically) by manipulating the audio reaching our ears. The advent of high performance digital signal processing hardware and tools has lent itself to the development of various digital filtering techniques used in the reproduction of headphone-based three-dimensional sound reproduction. For example, Head-Related Transfer Functions (HRTF) utilized within digital signal processors provide filtering means capable of creating the illusion of three-dimensional sound for the headphone-user.

Thus, it would be an advancement in the state of the art to enhance the three-dimensional effect of reproduced sound in audio headphone technology.

SUMMARY

Accordingly, the present invention is directed to a method and apparatus that is related to three-dimensional (3D) audio reproduction headphones or headsets. This may apply to 3D audio reproduction (e.g., moves, music), computer gamming interaction capabilities, computer environment input (e.g., computer mouse movement), and external sound monitoring.

One embodiment of the present invention is directed to a headphone device that includes and an assembly, a first ear piece and second ear piece, a motion transducer, an electronic compass, and a processing device. The first ear piece and second ear piece are coupled to the assembly for facilitating the placement of the first and second ear piece in relation to a user's ears. The motion transducer is coupled to either the first ear piece or the second ear piece, and is operable to measure real-time pitch and roll movement associated with the user's head. The electronic compass is also coupled to either the first ear piece or the second ear piece, and is operable to measure real-time yaw movement associated with the user's head. The processing device, which is associated with each of the first ear piece and the second ear piece, processes an audio signal according to a head-related-transfer-function (HRTF) selected from a plurality of head-related-transfer-functions on the basis of the measured pitch, roll, and yaw movement of the user's head. The processed audio signal is then applied to the first and second ear piece for generating a virtual three-dimensional sound corresponding to the selected head-related-transfer-function.

Yet another embodiment of the present invention is directed a headphone device that includes an assembly having a first ear piece and a second ear piece. The assembly facilitates the placement of the first and second ear piece in relation to a user's ears. A first sensory device coupled to the assembly generates first signal information corresponding to a pitch and roll movement associated with the user's head, while a second sensory device also coupled to the assembly generates second signal information corresponding to a yaw movement associated with the user's head. A processing device receives the generated first signal information and second signal information and processes an audio signal according to a head-related-transfer-function (HRTF) selected from a plurality of head-related-transfer-functions on the basis of the generated first and second signal information. The processed audio signal is then applied to the first and second ear piece for generating a virtual three-dimensional sound corresponding to the selected head-related-transfer-function.

Yet another embodiment of the present invention is directed to a headphone system adapted for use in a gaming environment. The headphone system includes an assembly having a first and a second ear piece, whereby the assembly facilitates the placement of the first and second ear piece in relation to a user's ears. A first sensory device is coupled to the assembly and generates first signal information corresponding to a pitch and roll movement associated with the user's head, while a second sensory device is also coupled to the assembly and generates second signal information corresponding to a yaw movement associated with the user's head. A communications device receives the first and second signal information for transmission to the gaming environment. A processing device, which is coupled to the communication device, receives third signal information from the gaming environment based on the transmitted first and second signal information. The processing device then processes an audio signal according to a head-related-transfer-function selected from a plurality of head-related-transfer-functions based on the third signal information. The processed audio signal is applied to the first and second ear piece for generating a virtual three-dimensional sound corresponding to the selected head-related-transfer-function.

Yet another embodiment of the present invention is directed to a headphone system adapted for use in a computer environment. The headphone device includes an assembly having a first and a second ear piece, where the assembly facilitates the placement of the first and second ear piece in relation to a user's ears. A first sensory device is coupled to the assembly and generates first signal information corresponding to a pitch and roll movement associated with the user's head, while a second sensory device is also coupled to the assembly generates second signal information corresponding to a yaw movement associated with the user's head. A processing device is coupled to a communications device, whereby the processing device receives the generated first and second signal information for generating head movement information for transmission to the computer environment via the communications device. The transmitted head movement information is then received by the computer environment and translated into at least one computer input command.

Yet another embodiment of the present invention is directed to a headphone device including an assembly having a first and a second ear piece, where the assembly facilitates the placement of the first and second ear piece in relation to a user's ears. A first sensory device is coupled to the assembly and operable to generate first signal information corresponding to a pitch and roll movement associated with the user's head, while a second sensory device is also coupled to the assembly and generates second signal information corresponding to a yaw movement associated with the user's head. A microphone device coupled to the assembly detects external sound from the user's environment. A processing device receives the generated first and second signal information for detecting position information associated with the user's head, and also receives the detected external sound for determining the direction of the external sound. The processing device then mixes the detected external sound with an audio signal based on the detected position information and the direction of the external sound. The external sound mixed with the audio signal is processed according to a head-related-transfer-function selected from a plurality of head-related-transfer-functions on the basis of the detected position information, where the external sound mixed with the audio signal is applied to the first and second ear piece for generating a virtual three-dimensional sound corresponding to the selected head-related-transfer-function.

Yet another embodiment of the present invention is directed to a headphone device that includes a first and a second ear piece. The headphone device comprises a motion sensing device operable to generate both first signal information corresponding to a pitch and roll movement associated with a user's head and generate second signal information corresponding to a yaw movement associated with the user's head. A processing device operable to receive the generated first and second signal information then processes an audio signal according to a head-related-transfer-function on the basis of the received first and second signal information. The processed audio signal is applied to the first and second ear piece for generating a virtual three-dimensional sound corresponding to the selected head-related-transfer-function.

Yet another embodiment of the present invention is directed to a method of generating three-dimensional sound in a headphone device including a first ear piece and a second ear piece. The method includes generating first signal information corresponding to a pitch and roll movement associated with a user's head, and generating second signal information corresponding to a yaw movement associated with the user's head. The generated first and second signal information is processed for determining position information associated the user's head. An audio signal is then processed according to a head-related-transfer-function selected on the basis of the determined position information, where the processed audio signal is applied to the first and second ear piece for generating a virtual three-dimensional sound corresponding to the selected head-related-transfer-function.

Other embodiments of the present invention include the methods described above but implemented using apparatus or programmed as computer code to be executed by one or more processors operating in conjunction with one or more electronic storage media.

BRIEF DESCRIPTION OF THE DRAWINGS

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages, embodiments and novel features of the invention may become apparent from the following description of the invention when considered in conjunction with the drawings. The following description, given by way of example, but not intended to limit the invention solely to the specific embodiments described, may best be understood in conjunction with the accompanying drawings, in which.

DETAILED DESCRIPTION

It is noted that in this disclosure and particularly in the claims and/or paragraphs, terms such as "comprises," "comprised," "comprising," and the like can have the meaning attributed to it in U.S. patent law; that is, they can mean "includes," "included," "including," "including, but not limited to" and the like, and allow for elements not explicitly recited. Terms such as "consisting essentially of" and "consists essentially of" have the meaning ascribed to them in U.S. patent law; that is, they allow for elements not explicitly recited, but exclude elements that are found in the prior art or that affect a basic or novel characteristic of the invention. These and other embodiments are disclosed or are apparent from and encompassed by, the following description. As used in this application, the terms "component" and "system" are intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers.

Figure 1:
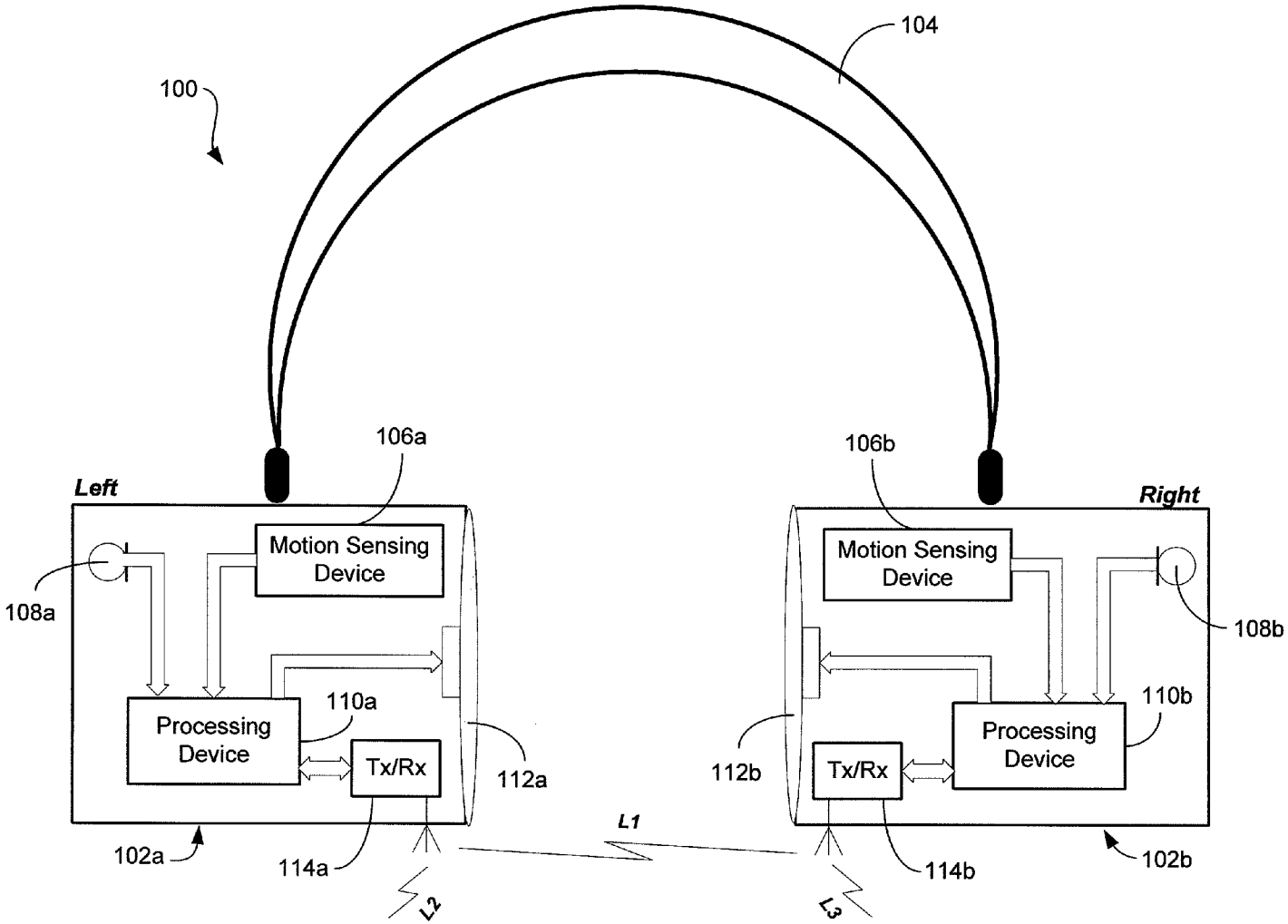
FIG. 1 illustrates a headphone device according to an embodiment of the present invention.

FIG. 1 illustrates a headphone device 100 according to an embodiment of the present invention. The headphone device 100 includes a left ear piece 102*a* and a right ear piece 102*b* that are both coupled to an assembly 104. In the illustrated embodiment, the assembly 104 facilitates the placement of the ear pieces 102*a*, 102*b* with respect to the user's ears. It will be appreciated, however, that a headphone assembly 104 may take on many different forms. For example, the assembly

104 of headphone device 100 couples both the ear pieces 102*a*, 102*b* together and is placed over the user's head.

Other assemblies (not shown) may couple both left and right ear pieces, while being placed behind the user's head. Some headphones do not have assemblies that couple the ear pieces together. For example, in-ear headphone devices are maintained in position by virtue of snug placement of the ear pieces within the user's ear canals. In such headphone configurations, the assembly may form part of the ear piece itself. For example, the portion of each ear piece that is placed within the ear canal may constitute an assembly. In light of the numerous types of headphone types, and in particular, the different ways and means by which they are retained in proximity to a user's ears, an assembly is generally referred to as any structural characteristic of the headphone device that facilitates the placement of the ear pieces in relation (e.g., within the ear, over the ear, etc.) to the user's ears. Furthermore, the headphone assembly 104 may be an insulated wire, plastic coated cord, flexible polymer material, or other suitable material.

Ear piece 102*a* (i.e., Left) includes a motion sensing device 106*a*, a microphone 108*a*, a processing device 110*a*, an audio transducer 112*a*, and a communication device such as a transceiver 114*a*. Similarly, ear piece 102*b* (i.e., Right) includes a motion sensing device 106*b*, a microphone 108*b*, a processing device 110*b*, an audio transducer 112*b*, and a communication device such as a transceiver 114*b*. As will be described in the following paragraphs, both the left ear piece 102*a* and the right ear piece 102*b* have the same components and may operate in an identical manner. However, either ear piece may be configured to provide identical, redundant and/or additional functionality during operation. According to the different embodiments described herein, microphone devices 108*a* and 108*b* (FIGS. 1 and 2) may be optionally included for providing additional features with respect to the headphone device 100. For example, as described in the following paragraphs, microphone devices 108*a* and 108*b* may be utilized in the detection of external sound while the user is wearing the headphone device 100. In such an embodiment, external sound that is detected by either or both the microphone devices 108*a*, 108*b* is reproduced through the headphone device 100 in real-time for the user's attention. Therefore, based on whether additional sound detection or other features are desired, microphone devices 108*a* and 108*b* (FIGS. 1 and 2) may be optionally omitted from the headphone device 100.

Within ear piece 102*a*, the microphone 108*a* is operable to detect and convert sound that is external to the headphone device (e.g., from surrounding environment) into an electrical signal for processing by the processing device 110*a*. The output of the microphone 108*a* may either be in analog or digital format. In some embodiments, the microphone 108*a* generates a digitized output signal corresponding to the measured sound. In other embodiments, the microphone 108*a* output is analog, in which case, the analog output may be digitized at the processing device 110*a*.

The motion sensing device 106*a* is operable to measure the pitch, roll, and yaw movement of the user's head in order to re-synthesize the manner in which three-dimensional sound is reproduced. For example, in a non-headphone audio environment, a series of speakers may be configured to recreate a three-dimensional surround sound experience. According to, for example, a 5-1 speaker configuration, five speakers and a low frequency subwoofer are utilized. Typically, three speakers are located in the front with respect to a listener's position and two speakers are located in the rear of the user. The additional subwoofer is also placed in the front. In such a configuration, the listener benefits from the 3D sound reproduction experience when the listener is disposed in an optimum position relative to the five speakers (i.e., the "sweet spot"). When using headphones, the motion of the user's head tends to simulate the movement of a listener with respect to the location of speakers. For example, as the head leans toward the left (i.e., changing the roll), this simulates the movement of the left/front and left/back speakers towards the listener's ear. Nodding the head down (i.e., changing the pitch) accordingly emulates the movement of the front speakers towards the listener's ears. With speakers, if the position of the listener with respect to speakers changes with respect to the sweet spot or optimum location, the three-dimensional (3D) sound experience deteriorates. Therefore, in order to overcome this, either the speaker positions have to be reconfigured, or the listener is required to move back to the optimum listening position. As described above, movement of the head when using headphones causes the same or similar effect than that caused by listener movement during the use of 3D sound producing speaker systems (e.g., 5-1 speaker configuration). That is, 3D sound reproduction experienced by the user departs from an optimum setting. Therefore, the motion sensing device 106*a* optimizes the re-synthesis of 3D sound in the headphones based on the measured pitch, roll, and yaw movement of the user's head.

The processing device 110*a* receives signal information corresponding to the measured pitch, roll, and yaw movement of the user's head. Processing device 110*a* also receives an electrical signal corresponding to detected sound that is picked up via the headphone device 100. By processing the signal information corresponding to the measured pitch, roll, and yaw movement, the processing device 110*a* is capable of determining the position of the user's head for re-synthesis of the 3D sound. The processing device 110*a* also processes the electrical signal corresponding to the detection of sound via the headphone device 100 in order to determine the direction of the sound. If the determined sound direction correlates to one or more preset criteria, the processor 110*a* may amplify (if necessary) and mix the detected sound with any existing audio signal playing through the headphones 100. The microphone 108*a*, among other things, provides a means by which a headphone user is alerted to external sound. This may provide a number of different uses, such as but limited to, safety, preselected sound detection, etc. In a safety utility mode, the user is made aware of sound from a particular direction. For example, the microphone 108*a* may be used to determine sound from an approaching vehicle. Alternatively, in the preselected sound detection mode, the microphone 108*a* detects sound of a particular frequency or frequency signature. For example, the headphone user may be alerted when a door bell or telephone rings. Similarly, the headphone user may be alerted upon detection of a car or house alarm.

The microphone 108*a* may comprise a microphone system having an array of sound detection transducers and filters for the purpose of determining the direction of detected external sound as well its intensity. In other embodiments, microphone 108*a* (i.e., from the left ear piece) and microphone 108*b*, for example, from the right ear piece, may be used in cooperation to detect external sound and determine its direction.

The transceiver 114*a* provides both transmitter and receiver capabilities via wired and/or wireless communication technologies and protocols. The transceiver 114*a* is able to facilitate communication between ear piece 102*a* and ear piece 102*b*, for example, communication link L1. For example, processed external sound that is detected by microphone 108*b* and processed by processing device 110*b* may be transmitted from transceiver 114*b* to transceiver 114*a* for further processing at processing device 110*a* (e.g., external sound direction determination, mixing of external sound with headphone's audio, etc.). The transceiver 114*a* is also able to facilitate communication between ear piece 102*a* and an external device, for example, communication link L2, such as one or more computers or gamming devices.

The audio transducers 112*a*, 112*b* receive reproduced 3D audio from the processing device 110*a*, whereby the processed 3D audio is converted from the electrical domain into an acoustic output at the audio transducers 112*a*, 112*b*. Similarly, according to another configuration, the audio transducers 112*a*, 112*b* may receive reproduced 3D audio from processing device 110*b*. Further, according to yet another configuration, audio transducers 112*a* and 112*b* may be adapted to receive reproduced 3D audio from both processing devices 110*a* and 110*b*, respectively.

As previously described above, the components of the right ear piece 102*b* are identical to those of the left ear piece 102*a*. For example, motion sensing device 106*b* may be identical to motion sensing device 106*a*, microphone 108*b* may be identical to microphone 108*a*, processing device 110*b* may be identical to processing device 110*a*, audio transducer 112*b* may be an identical to audio transducer 112*a*, and transceiver 114*b* may be identical to transceiver 114*a*. Although the components within each ear piece 102*a*, 102*b* may be identical, their use and functionality may vary according to different device architectures.

For example, according to one embodiment of the invention, either the left ear piece 102*a* or the right ear piece 102*b* may act as a primary functioning unit, while the other ear piece acts as a secondary redundant unit. In the even that one or more processing capabilities (e.g., 3D sound reproduction) within the primary functioning unit fails, the secondary redundant unit may become operable. According to another embodiment of the invention, both the ear pieces 102*a*, 102*b* may operate in a split functionality mode. For example, the left ear piece 102*a* may detect the user's head movement and generate 3D audio for delivery to the user's ears via the audio transducers 112*a*, 112*b*. The right ear piece 102*b* may also detect the user's head movement and transmit head movement data to a computer or gaming device while running interactive applications on a computer or gamming device. In a split functionality mode, processing resources may be distributed between the left and the right ear piece 102*a*, 102*b* based on the processing requirements imposed by, for example, HRTF processing; interactive communication and processing with external systems such as computers and gamming systems, for example, a PLAYSTATION 3™ (PS3™) PLAYSTATION PORTABLE™ (PSP™) and PLAYSTATION NETWORK™ (PSN™); external sound detection and processing; etc. This distribution of processing resources among the ear pieces 102*a*, 102*b* may be accomplished in a predetermined manner by setting a switch (not shown) or altering the program executing in the processing device 110*a* by, for example, downloading or loading configuration software onto the processing device 110*a* or other components (e.g., a memory unit) of the headphone device 100. Alternatively, the distribution of processing resources among the ear pieces 102*a*, 102*b* may be accomplished dynamically in real-time via resource balancing software or firmware running on either or both processing devices 110*a*, 110*b*.

Figure 2:
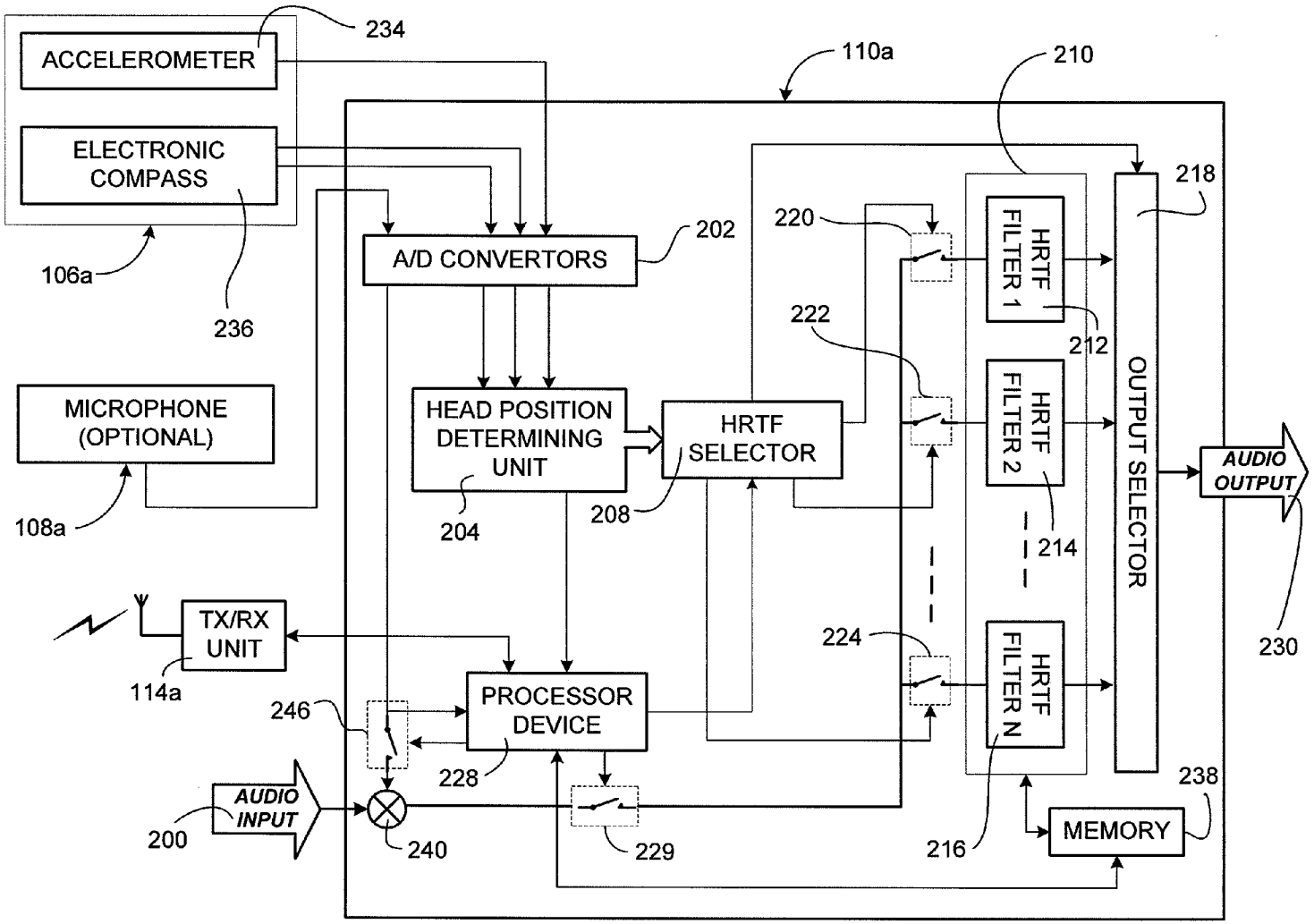
FIG. 2 is a block diagram associated with the headphone device illustrated in FIG. 1 according to an embodiment of the present invention.

FIG. 2 illustrates a block diagram of the processing device 110*a* of ear piece 102*a* according to an embodiment of the invention. Since the description of processing device 110*b* is identical to that of processing device 110*a*, as will be understood by one skilled in the art in view of this Specification, processing device 110*b* is similar to processing device 110*a* as described herein. The processing device 110*a* includes an analog to digital (A/D) convertor 202 for digitizing analog signal that are input to the processing device 110*a*; a head position determining unit 204 for generating data corresponding to the position of a user's head; an HRTF selector unit 208 for selecting a particular HRTF filter based on the position of the user's head; an HRTF filter bank 210 having a plurality of HRTF filter devices 212, 214, 216 for 3D sound reproduction; a plurality of switch devices 220, 222, 224 each controlled by the HRTF selector unit 208; an output selector 218 for selecting an appropriate output associated with one of the selected HRTF filter devices 212-216; a memory device 238 (e.g., loadable memory stick, removable RAM, flash memory or other electronic storage medium) for storing digital filter parameters (e.g., filter coefficients) for controlling the transfer function of each of the HRTF filter devices 212-216; an audio mixing device 240 for (optionally) mixing an external sound source with a received audio signal 200; and a processor device 228 for controlling the operation of the components within the processing device 110*a*.

Several devices are coupled to the processing device 110*a*. Transceiver 114*a* is coupled to the processor device 228 via either a wireless (e.g., BlueTooth®) or wired (e.g., Universal Serial Bus) communication link. Microphone 108*a* and motion sensing device 106*a* are also coupled to the processing device 110*a* via the D/A convertor 202. An audio signal is input 200 to the processing device 110*a* via mixing device 240.

As illustrated in FIG. 2, the motion sensing device 106*a* includes position determining devices such as an accelerometer device 234 and a compass 236, which may be for example an electronic compass. The accelerometer device 234 is adapted to determine the pitch and roll movement of the user's head, while the compass 236 measures yaw movement associated with the user's head. In some instances, the output from the accelerometer device 234 and the compass 236 may be in a digitized format. Accordingly, the output from the accelerometer device 234 and the electronic compass 236 is directly coupled to the head position determining unit 204. Alternatively, the output from the accelerometer device 234 and the electronic compass 236 may be in analog signal form, whereby the analog signal is digitized by the AID convertor 202 of processing device 110*a*.

Figure 3:
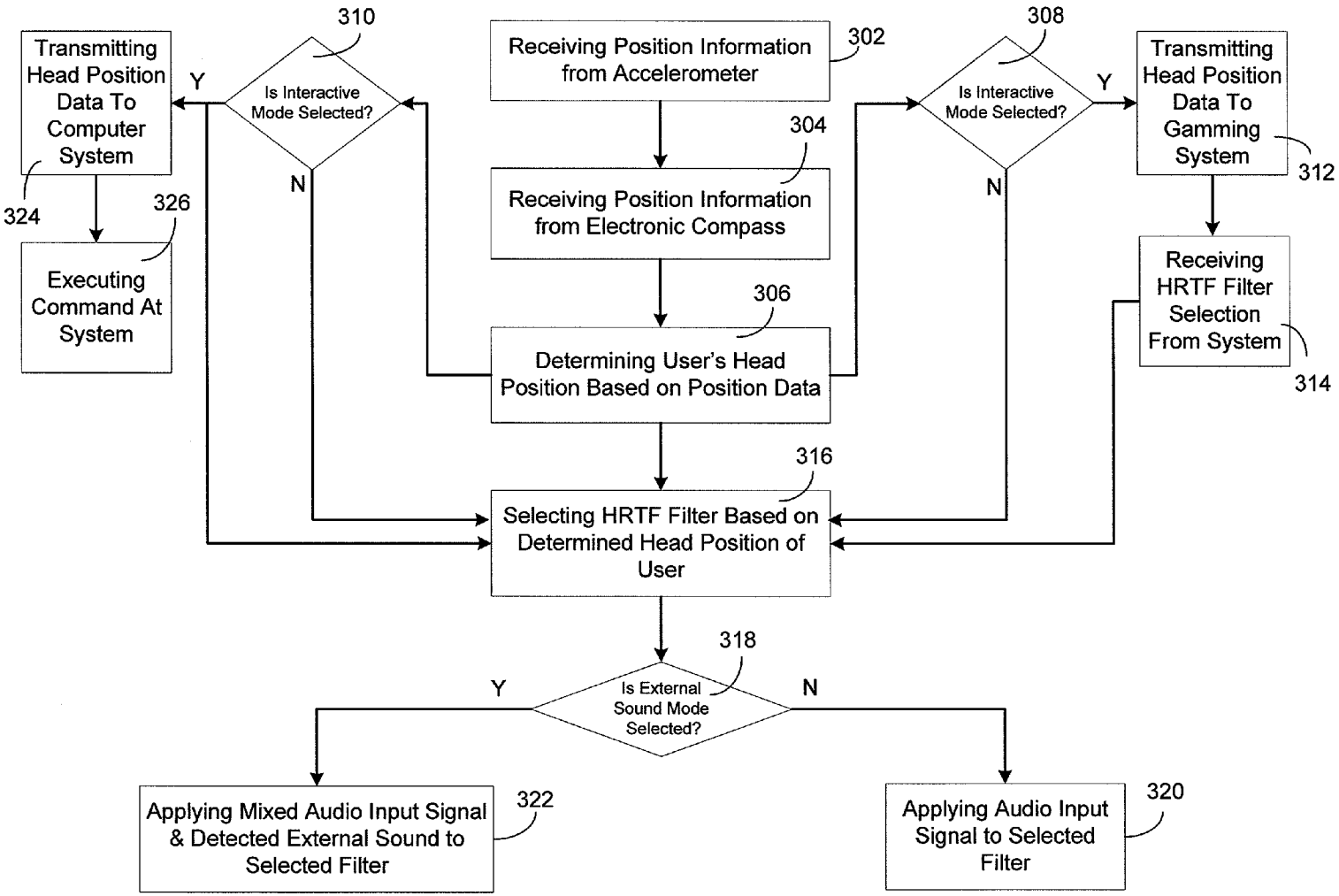
FIG. 3 is operational flow diagram of a headphone device according to an embodiment of the present invention.

The operation of the headphone device 100 will now be explained with the aid of the flow diagram illustrated in FIG. 3, and FIGS. 1 and 2. At step 302, position information corresponding to the pitch and roll movement of the user's head is received by the processing device 110*a* from accelerometer 234. The position information (i.e., pitch and roll) is then converted to a digital format by the A/D convertor 202. Similarly, at step 304, position information corresponding to the yaw movement of the user's head is also received by the processing device 110*a* from accelerometer 234. This position information (i.e., pitch and roll) is also converted to a digital format by the A/D convertor 202.

At step 306, the head position determining unit 204 receives and processes the position information corresponding to the pitch, roll, and yaw movement of the user's head. Based on this processing, the head position determining unit 204 generates head position data, which may include a data code that it associated with a particular head position.

At steps 308 or 310, it is determined whether an interactive mode has been selected, where step 308 corresponds to a first interactive mode and step 310 applies to a second interactive mode. If a first interactive mode is selected (step 308), the head position data generated by the head position determining unit 204 is transmitted, under the control of processor device 228, to a gamming system, or other system, such as a network system, (not shown) via transceiver 114*a* (step 312). At step 314, the gamming system transmits a desired HRTF filter selection to the headphone's 100 transceiver 114*a* based on the received head position data. For example, the gamming environment may associate a particular 3D sound reproduction effect with the received head position data corresponding to the user. At step 316, the transceiver 114*a* receives and couples the desired HRTF filter selection to the processor 228. The processor 228 then commands the HRTF selector 208 to select one of the plurality of HRTF filters 212-216 within the filter bank 210. Based on the processor's 228 command, the HRTF selector 208 activates one of the switches 220-224 in order to couple the input audio signal 200 (via mixing device 240) to the desired HRTF filter.

At step 318, it is determined whether an external sound mode has been selected. If an external mode has not been selected by the user (step 318), the processor 228 activates switch 229 and the audio input signal is coupled to the desired HRTF filter (e.g., filter 214) via the mixing device 240, whereby no additional signal is mixed with the input audio signal. Thus, the audio input signal 200 is filtered by the desired HRTF filter in order to simulate a 3D sound reproduction (step 320). The output of the filter is then received by the output selector 218. The output selector 218 includes a digital to analog (D/A) convertor for converting the filtered audio input signal from a digital format to a filtered analog output signal 230. The output signal 230 is then applied to the audio transducers 112*a*, 112*b* for generating and delivering 3D sound to the user.

If an external mode has been selected by the user (step 318), the processor 228 activates switches 229 and 246, whereby the audio input signal 200 and an additional signal corresponding to the external sound received from the microphone 108*a* are mixed by the mixing device 240 and coupled to the desired HRTF filter (e.g., filter 214) (step 322). The processor 228 activates switch 246 upon processing the external sound detected by the microphone 108*a*. Accordingly, the processor 228 processes detected sound from either or both microphones 108*a* and 108*b* and determines the direction of the sound. If the determined direction of the processed sound is within a predetermined criteria and range (e.g., behind user covering a 90° angular range, immediate left side of user covering a 60° angular range, etc.), the processor 228 activates switch 246 for mixing the input audio and received external sound.

If a second interactive mode is selected (step 310), the head position data generated by the head position determining unit 204 is transmitted, under the control of processor device 228, to a computer system (not shown) via transceiver 114*a* (step 324). At step 326, the computer system then performs a function based on the received head position data. For example, one function may include moving a mouse cursor on the computer screen as the user's head moves. As the user's head moves, the head position data is transmitted (in real-time) to the computer for generating the cursor movement. It will be appreciated that a multitude of endless functionality may be associated with the transmitted head position data. For example, another function may include highlighting certain areas on the computer screen as the user's head moves.

If at steps 308 and 310, it is determined that no interactive mode has been selected, following step 306, the processor device commands the HRTF selector 208 to select one of the plurality of HRTF filters 212, 214, 216 based on the head position data generated by the head position determining unit 204 (316). The HRTF selector 208 then activates one of the switches 220, 222, 224 in order to couple the input audio signal 200 (via mixing device 240) to the desired HRTF filter (step 316). If an external mode has not been selected by the user (step 318), the processor 228 activates switch 229 and the audio input signal is coupled to the selected HRTF filter (e.g., filter 214) via the mixing device 240, whereby no additional signal is mixed with the input audio signal. Thus, the audio input signal 200 is filtered by the selected HRTF filter in order to simulate a 3D sound reproduction (step 320). The output of the filter is then received by the output selector 218. The output selector 218 includes a digital to analog (D/A) convertor for converting the filtered audio input signal from a digital format to a filtered analog output signal 230. The output signal 230 is then applied to the audio transducers 112*a*, 112*b* for generating and delivering 3D sound to the user. It may be possible to operate the headphone device 100 according to any one or more combinations of the above-described modes (i.e., interactive modes, external sound mode). For example, in one embodiment, both interactive modes and the external sound mode may be selected. According to another embodiment, for example, one interactive mode and the external sound mode may be selected. The user may, however, desire to operate the headphone without any mode being selected.

Figure 4:
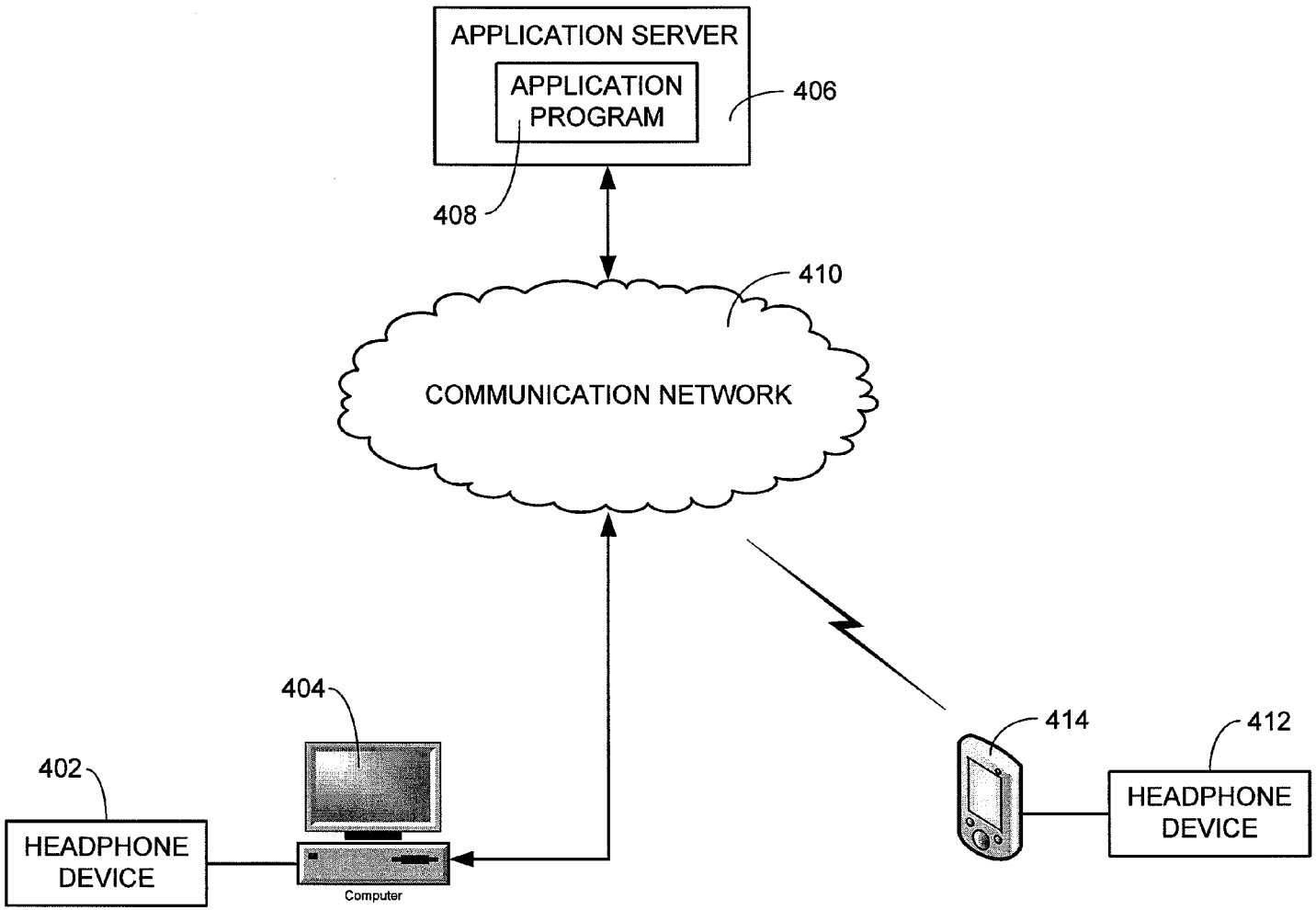
FIG. 4 is a system diagram illustrative of several headphone devices in communication with a server device via a communication network according to an embodiment of the invention.

FIG. 4 is a system diagram 400 illustrative of several headphone devices 402, 412 in communication with a server device 406 via a communication network 410 according to an embodiment of the invention. For example, headphone device 402 may be coupled to a local computer 404 that runs an interface program (not shown) for downloading various operational features onto the headphone device 402. The user may access these various features using the application server's 406 application program 408. For example, the various operation features may include different digital filter parameters (e.g., coefficients) and programmable attributes. The user may, therefore, download these operational features from the application program 408 running on the server 406 using computer 404. Similarly, another user may download the various operational features from the application program 408 to their headphone device 412 using a Personal Digital Assistant (PDA) 414.

Any downloaded features may be stored within the memory 238 (FIG. 2) of the headphone's processing device 110*a* (FIG. 2). Under the control of processor device 228, the stored features may be loaded within one or more of the digital filters 212-216 (FIG. 2) located within the filter bank 210 (FIG. 2).

Figure 5:
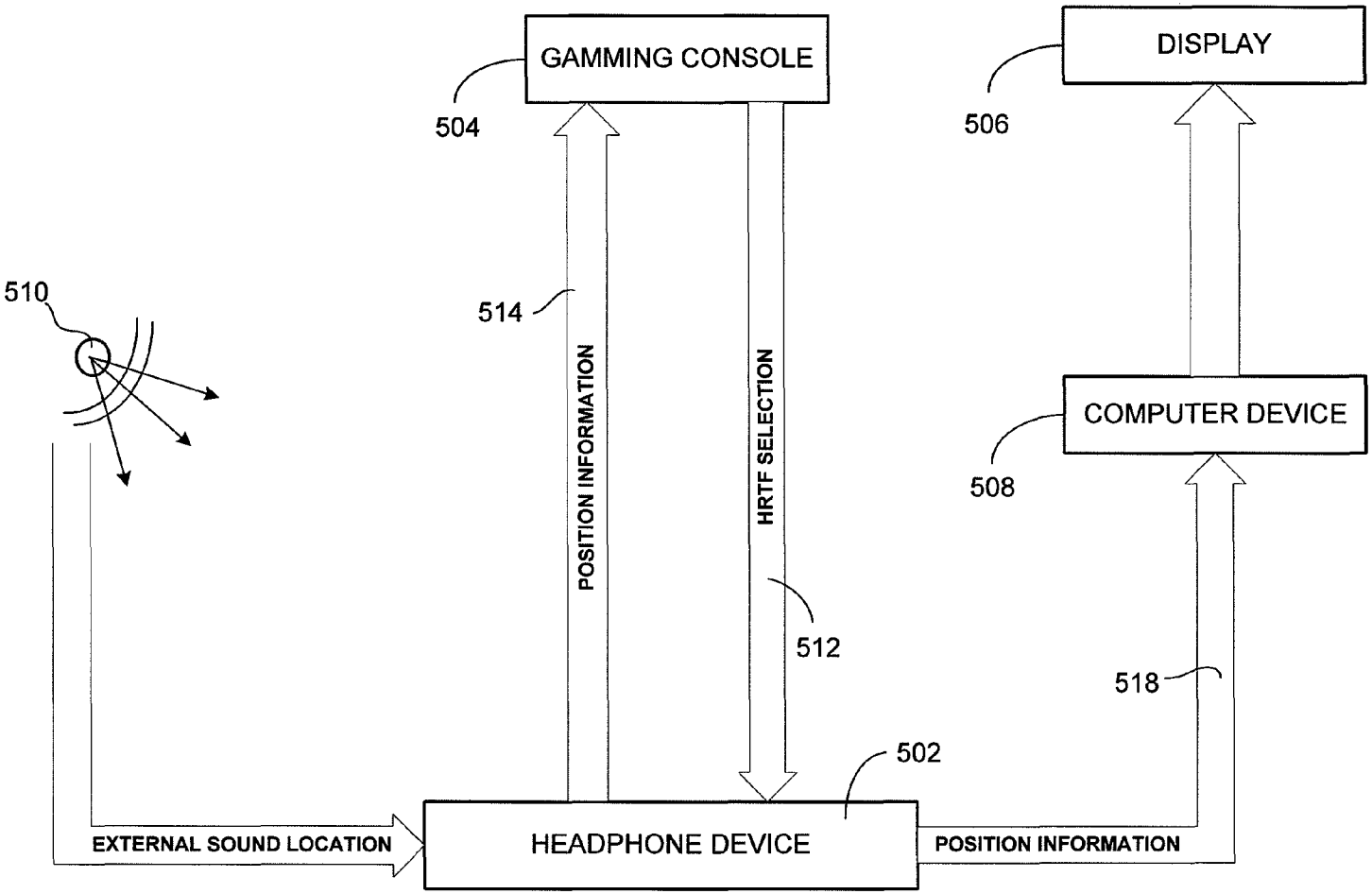
FIG. 5 is a system diagram illustrating information flow between a headphone device and other devices according to an embodiment of the invention.

FIG. 5 illustrates information flow 500 between a headphone device and other devices according to an embodiment of the invention. A headphone device 502 may operate based on several described interactive modes. For example, the headphone device 502 may generate 3D sound based solely on the real time tracking of a user's head position according to measured pitch, roll, and yaw information.

In addition, the headphone device 502 may generate 3D sound based on the exchange of position information 514 (i.e., pitch, roll, and yaw information) with a gamming console 504. The gamming console may then make a desired HRTF filter selection 512, which it transmits back to the headphone device 502. The headphone device 502 proceeds to reproduce 3D sound in accordance with the selected HRTF filter defined by the console 504. Throughout a game, the console 504 may continuously or sporadically interact with headphone device 502 in this manner. Also, based on a user manipulating their head and generating a particular set of position information, the user may be able generate responsive input within the game. For example, the user moving their head may translate to a character in the game moving their head.

Further, in addition to the headphone device 502 generating 3D sound based on position information 518, the headphone device 502 may simultaneously exchange this position information 518 (i.e., pitch, roll, and yaw information) with a computer device 508. The computer device may then translate the position information 518 into a particular computer input such as mouse movement, selection of one or more options displayed on the computer display 506, generation of a graphical effect, etc. Display unit 506 may be a monitor, display screen, CRT, LCD, flat screen display unit, graphical user interface, or other suitable electronic display device that displays data using an electronic representation, such as pixels.

Also, the location of an external sound source 510 may be detected and processed by the headphone device 502. Information associated with the direction of the external sound may be used to determine whether to mix this sound with the existing 3D audio being playing through the headphone device 502. Thus, the mixed sound acts as, among things, a safety feature for alerting a user to a particular sound coming from a particular direction. In accordance with some embodiments, it may desirable to mix only designated sounds (e.g., a car alarm, a telephone, a baby crying, etc.).

It is to be understood that the present invention can be implemented in various forms of hardware, software, firmware, special purpose processes, or a combination thereof. In one embodiment, at least parts of the present invention can be implemented in software tangibly embodied on a computer readable program storage device. The application program can be downloaded to, and executed by, any headphone device comprising a suitable architecture.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A headphone device comprising:

an assembly;

a first ear piece and a second ear piece coupled to the assembly, wherein the assembly is operable to facilitate the placement of the first and second ear piece in relation to a user's ears;

a motion transducer coupled to the first ear piece or the second ear piece, wherein the motion transducer is operable to measure real-time pitch and roll movement associated with the user's head;

an electronic compass coupled to the first ear piece or the second ear piece, wherein the electronic compass is operable to measure real-time yaw movement associated with the user's head;

a microphone device coupled to the assembly and operable to detect external sound; and a processing device associated with each of the first ear piece and the second ear piece for processing an audio signal according to a head-related-transfer-function selected from a plurality of head-related-transfer-functions on the basis of the measured pitch, roll, and yaw movement of the user's head, and operable to receive the detected external sound, the processing device mixing the detected external sound with the audio signal, wherein the processed audio signal mixed with the external sound is applied to the first ear piece and second ear piece for generating a virtual three-dimensional sound corresponding to the selected head-related-transfer-function, and wherein in a safety utility mode external sound from a particular direction is amplified by the processing device, and wherein in a preselected sound detection mode external sound of a particular frequency is amplified by the processing device.

2. The headphone device according to claim 1, wherein the motion transducer comprises an accelerometer device.

3. The headphone device according to claim 1, wherein the electronic compass comprises a digital compass.

4. The headphone device according to claim 1, wherein the processing device comprises a programmable digital filter operable to filter the audio signal according to any one of the plurality of head-related-transfer-functions selected.

5. The headphone device according to claim 1, wherein each of the plurality of head-related-transfer-functions are modeled based on listening cues obtained according to different positions of the user's head.

6. The headphone device according to claim 1, further comprising a first and a second headphone transducer respectively associated with the first and the second ear piece, wherein the first and the second headphone transducer convert the processed audio signal into an acoustic signal corresponding to the virtual three-dimensional sound.

7. Aheadphone device comprising:

an assembly having a first and a second ear piece, wherein the assembly facilitates the placement of the first and second ear piece in relation to a user's ears;

a first sensory device coupled to the assembly and operable to generate first signal information corresponding to a pitch and roll movement associated with the user's head;

a second sensory device coupled to the assembly and operable generate second signal information corresponding to a yaw movement associated with the user's head;

a microphone device coupled to the assembly and operable to detect external sound; and a processing device operable to receive the generated first and second signal information, the processing device processing an audio signal according to a head-related-transfer-function selected from a plurality of head-related-transfer-functions on the basis of the generated first and second signal information, and operable to receive the detected external sound, the processing device mixing the detected external sound with the audio signal, wherein the processed audio signal is applied to the first and second ear piece for generating a virtual three-dimensional sound corresponding to the selected head-related-transfer-function, and wherein in a safety utility mode external sound from a particular direction is amplified by the processing device, and wherein in a preselected sound detection mode external sound of a particular frequency is amplified by the processing device.

8. The headphone device according to claim 7, wherein the generated first and second signal information comprise analog signals.

9. The headphone device according to claim 7, wherein the generated first and second signal information comprise digital signals.

10. A headphone system adapted for use in a gaming environment, the headphone system comprising:

an assembly having a first and a second ear piece, wherein the assembly facilitates the placement of the first and second ear piece in relation to a user's ears;

a first sensory device coupled to the assembly and operable to generate first signal information corresponding to a pitch and roll movement associated with the user's head;

a second sensory device coupled to the assembly and operable generate second signal information corresponding to a yaw movement associated with the user's head;

a communications device operable to receive the first and second signal information for transmission to the gaming environment;

a microphone device coupled to the assembly and operable to detect external sound; and a processing device coupled to the communication device for receiving third signal information from the gaming environment based on the transmitted first and second signal information, the processing device operable to process an audio signal according to a head-related-transfer-function selected from a plurality of head-transfer-funtions on the basis of the third signal information, and operable to receive the detected external sound, the processing device mixing the detected external sound with the audio signal, wherein the processed audio signal is applied to the first and second ear piece for generating a virtual three-dimensional sound corresponding to the selected head-related-transfer-function, and wherein in a safety utility mode external sound from a particular direction is amplified by the processing device, and wherein in a preselected sound detection mode external sound of a particular frequency is amplified by the processing device.

11. The headphone system according to claim 10, wherein the gaming environment comprises:

a gaming console; and a transceiver device coupled to the gaming console, wherein the gaming console receives the first and the second signal information transmitted from the communications device via the transceiver device, and transmits the third signal information to the communications device via the transceiver device.

12. The headphone system according to claim 11, wherein the selected head-related-transfer-function corresponds to simulate listening cues programmed into a particular game executing on the gaming console.

13. A headphone device comprising:

an assembly having a first and a second ear piece, wherein the assembly facilitates the placement of the first and second ear piece in relation to a user's ears;

a first sensory device coupled to the assembly and operable to generate first signal information corresponding to a pitch and roll movement associated with the user's head;

a second sensory device coupled to the assembly and operable to generate second signal information corresponding to a yaw movement associated with the user's head;

a microphone system coupled to the assembly and operable to detect external sound; and a processing device operable to receive the generated first and second signal information for detecting position information associated with the user's head, and operable to receive the detected external sound for determining the direction of the external sound, the processing device mixing the detected external sound with an audio signal based on the detected position information and the direction of the external sound, wherein the external sound mixed with the audio signal is processed according to a head-related-transfer-function selected from a plurality of head-related-transfer-functions on the basis of the detected position information, the external sound mixed with the audio signal being applied to the first and second ear piece for generating a virtual three-dimensional sound corresponding to the selected head-related-transfer-function, and wherein in a safety utility mode external sound from a particular direction is amplified by the processing device, and wherein in a preselected sound detection mode external sound of a particular frequency is amplified by the processing device.

14. The headphone device according to claim 13, wherein the microphone system comprises:

a plurality of spatially arranged audio transducers each operative to receive the external sound; and at least one output operable to couple the detected external sound based on the external sound received by the plurality of spatially arranged audio transducers.

15. A headphone device including a first and a second ear piece, the headphone device comprising:

a motion sensing device operable to:

(i) generate first signal information corresponding to a pitch and roll movement associated with a user's head;

(ii) generate second signal information corresponding to a yaw movement associated with the user's head;

a microphone device coupled to the assembly and operable to detect external sound; and a processing device operable to receive the generated first and second signal information, and process an audio signal according to a head-related-transfer-function on the basis of the received first and second signal information, and operable to receive the detected external sound, the processing device mixing the detected external sound with the audio signal, wherein the processed audio signal is applied to the first and second ear piece and generates a virtual three-dimensional sound corresponding to the selected head-related-transfer-function, and wherein in a safety utility mode external sound from a particular direction is amplified by the processing device, and wherein in a preselected sound detection mode external sound of a particular frequency is amplified by the processing device.

16. The headphone device according to claim 15, further comprising an audio sensing device comprising:

a plurality of spatially arranged audio transducers each operative to receive sound external to the headphone device; and at least one output operable to generate third signal information based on the external sound received by the plurality of spatially arranged audio transducers, wherein the generated third signal information is processed by the processing device for detecting the location of the sound relative to the headphone device, the processor mixing the received sound with an audio signal based on the detected location of the sound, wherein the sound mixed with the audio signal is processed according to a head-related-transfer-function selected from a plurality of head-related-transfer-functions on the basis of the first and second signal information received by the processing device from the sensing device, wherein the external sound mixed with audio signal applied to the first and second ear piece for generating a virtual three-dimensional sound corresponding to the selected head-related-transfer-function.

17. A method of generating three-dimensional sound in a headphone device including a first and a second ear piece, the method comprising:

generating first signal information corresponding to a pitch and roll movement associated with a user's head;

generating second signal information corresponding to a yaw movement associated with the user's head;

processing the generated first and second signal information for determining position information associated the user's head;

detecting external sound; and processing an audio signal according to a head-related-transfer-function selected on the basis of the determined position information;

mixing the detected external sound with the audio signal, wherein the processed audio signal is applied to the first and second ear piece for generating a virtual three-dimensional sound corresponding to the selected head-related-transfer-function, and wherein in a safety utility mode external sound from a particular direction is amplified, and wherein in a preselected sound detection mode external sound of a particular frequency is amplified.

18. The method according to claim 17, further comprising:

transmitting the first and second signal information to a gaming environment;

receiving third signal information from the gaming environment based on the first and second signal information transmitted to the gamming environment; and processing the audio signal according to another head-related-transfer-function selected on the basis of the third signal information.

19. The method according to claim 17, further comprising:

detecting external sound;

determining the direction of the external sound; and mixing the detected external sound with an audio signal based on the determined direction of the external sound.

20. The method according to claim 19, further comprising:

processing the external sound mixed with the audio signal according to another head-related-transfer-function selected from a plurality of head-related-transfer functions on the basis of the determined position information associated with the user's head.

21. The method according to claim 20, further comprising:

applying the processed external sound mixed with the audio signal being to the first and second ear piece for generating a virtual three-dimensional sound corresponding to the selected head-related-transfer-function.

22. The method according to claim 17, further comprising:

generating head movement information from the generated first and second signal information;

transmitting the generated head movement information to a computer environment; and translating the head movement information, at the computer environment, into at least one computer input command.

* * * * *